US005484168A

United States Patent [19]

Chigot

[11] Patent Number: 5,484,168

[45] Date of Patent: Jan. 16, 1996

[54] SHIPPING LABEL

[75] Inventor: Pierre Chigot, Vailly Sur Sauldre, France

[73] Assignee: Moore Business Forms, Inc., Grand Island, N.Y.

[21] Appl. No.: 131,749

[22] Filed: Oct. 5, 1993

[30] Foreign Application Priority Data

Oct. 22, 1992 [FR] France ..... 92 12653

[51] Int. Cl.[6] ..... B42D 15/00

[52] U.S. Cl. ..... 283/67; 283/79; 283/81; 283/103; 40/638; 428/41

[58] Field of Search ..... 283/67, 79, 81, 283/101, 105, 103; 40/638; 428/40, 41, 42, 43

[56] References Cited

U.S. PATENT DOCUMENTS

| | | | |
|---|---|---|---|
| Re. 33,139 | 1/1990 | Ashby . | |
| 3,226,862 | 1/1966 | Gabruk | 283/81 X |
| 3,421,239 | 1/1969 | Smith | 283/81 X |
| 3,593,443 | 7/1971 | Demetrius, Jr. et al. | 283/81 X |
| 3,822,492 | 7/1974 | Crawley | 283/81 X |
| 3,900,219 | 8/1975 | D'Amato et al. . | |
| 3,914,483 | 10/1975 | Stipek, Jr. | 283/81 X |
| 4,317,852 | 3/1982 | Ogden | 283/81 X |
| 4,379,573 | 4/1983 | Lomeli et al. . | |
| 4,549,750 | 10/1985 | Stone et al. | 283/81 X |
| 4,584,219 | 4/1986 | Baartmans | 283/81 X |
| 4,614,361 | 9/1986 | Foster . | |
| 4,667,984 | 5/1987 | Nitta . | |
| 4,688,826 | 8/1987 | Hosoya . | |
| 4,700,976 | 10/1987 | Loose . | |
| 4,799,712 | 1/1989 | Biava et al. . | |
| 4,821,439 | 4/1989 | Wilck . | |
| 4,868,027 | 9/1989 | Hunkeler et al. . | |
| 4,927,179 | 5/1990 | Ehret et al. . | |
| 4,955,640 | 9/1990 | Anderson . | |
| 4,983,438 | 1/1991 | Jameson . | |
| 4,995,642 | 2/1991 | Juszak et al. . | |
| 5,172,936 | 12/1992 | Sullivan . | |
| 5,207,458 | 5/1993 | Treichel et al. | 283/81 |

FOREIGN PATENT DOCUMENTS

| | | | |
|---|---|---|---|
| 412842 | 2/1991 | European Pat. Off. . | |
| 1023037 | 3/1953 | France | 283/81 |
| 2402264 | 4/1979 | France | 283/81 |
| 2634931 | 2/1990 | France . | |
| 3620264 | 12/1987 | Germany | 283/81 |
| 2179910 | 3/1987 | United Kingdom . | |

*Primary Examiner*—Frances Han
*Attorney, Agent, or Firm*—Nixon & Vanderhye

[57] ABSTRACT

A label assembly includes a backing of release material, a main label of label stock with adhesive substantially covering the bottom face of the main label, and first and second die cuts formed in the main label and backing respectively. The first die cut defines a secondary label within the main label, and the second die cut forms a first removable segment of the backing which overlaps the first die cut. The adhesive exerts a greater force on the first removable segment than does the rest of the backing so that when the main label is removed from the backing the first removable segment detaches from the backing and remains with the main and secondary labels. A tab integral with and extending outwardly from the secondary label is also exterior of the main label. When the main label is applied to a package, the secondary label does not stick to the package because of the presence of the first removable segment of the backing. After a signature or other acknowledgment is applied to the secondary label, the tab is grasped and the secondary label removed from the main label and package, and applied to another object, such as a piece of paper in a record book. A perforation line connects the tab to the secondary label so that it can be detached and discarded.

26 Claims, 2 Drawing Sheets

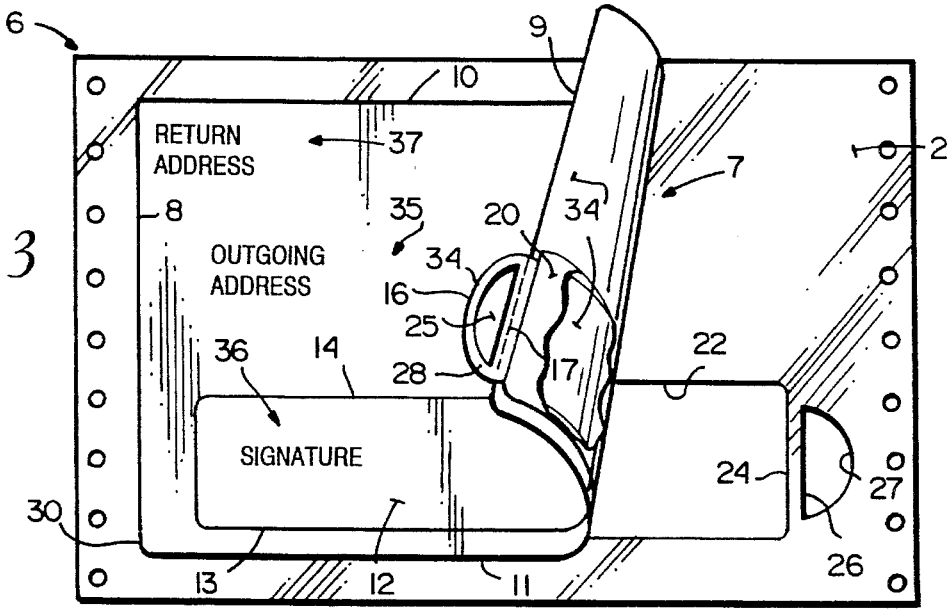
Fig. 3
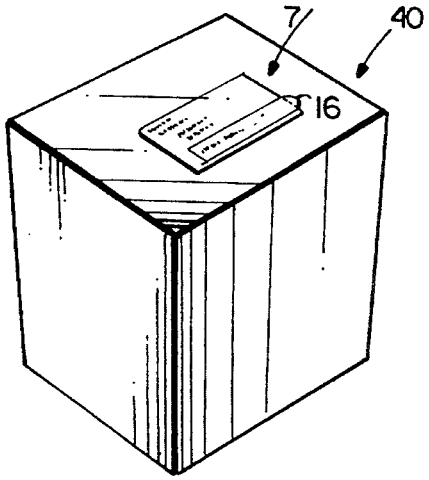
Fig. 4
Fig. 5
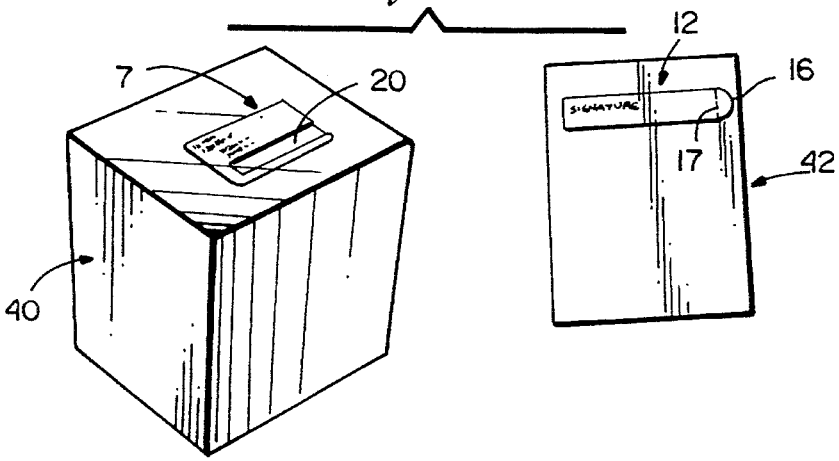

SHIPPING LABEL

BACKGROUND AND SUMMARY OF THE INVENTION

There are many circumstances in which it is desirable for someone shipping a package to receive an acknowledgment, or for a parcel handling organization to have a record of acknowledgment of parcels that have been delivered. This is traditionally accomplished by using multi-part forms, which can be cumbersome and which may contain more information than is necessary. Another way that this can be accomplished is by utilizing piggyback labels on a main label that is applied to the package, with shipping address information or the like. However, piggyback labels can be relatively expensive, and require additional manufacturing operations compared to conventional shipping labels.

According to the present invention, a label assembly, and a method of recording receipt of a package having a label assembly, are provided which allow acknowledgment of receipt of a package in a simple yet effective manner. The label assembly according to the present invention is easy to construct utilizing the same basic techniques as for the production of conventional labels, including the utilization of only a single type of adhesive, no multiple applications of adhesive being required. The basic feature of the label assembly according to the invention is the provision of a secondary label which is within the confines of a main label, with a release material backing covering the secondary label so that it does not stick to a package to which the main label is applied, but rather can be readily removed from the main label. The desirable results according to the invention are facilitated by providing a tab portion extending outwardly from a secondary label which can be grasped and used to remove the secondary label, but then can be discarded since it is connected to the secondary label by a perforation line.

According to one aspect of the present invention a label assembly is provided comprising the following elements: A backing of release material. A main label of label stock, having a top face and a bottom face. Adhesive substantially covering the bottom face. A first die cut formed in the main label, defining a secondary label substantially within the main label. And a second die cut formed in the backing overlapping the first die cut to define a first removable segment of the backing. The adhesive exerts a greater force on the first removable segment than the rest of the backing, so that when the main label is removed from the backing, the first removable segment detaches from the backing and remains with the main and secondary labels.

The label assembly also further preferably comprises a tab integral with and extending outwardly from the secondary label, and exteriorly of the main label. The adhesive is also typically provided on the bottom face of the tab, and there is a third die cut formed in the backing in alignment with the tab to define a second removable segment, with the adhesive exerting a greater force on the second removable segment than the rest of the backing so that when the main label is removed from the backing, the second removable segment detaches from the backing and remains with the tab. A line of weakness between the tab and the rest of the secondary label allows detachment of the tab once it has been utilized. The secondary label is quadrate, having four sides, and the first removable segment overlaps the secondary label along three sides, the tab extending from the fourth side.

First and second indicia are preferably provided on the top face of the main label and the secondary label, respectively, such as an outgoing address and a signature line. The label assembly typically is in web form in combination with a plurality of substantially identical labels, the backing of the labels connected together at lines of weakness. The adhesive is typically permanent adhesive completely covering the bottom face of the main and secondary labels.

According to another aspect of the present invention a label assembly is provided comprising the following elements: A main quadrate label having first through fourth sides, a top face, and a bottom face. A secondary quadrate label having first through fourth sides, a top face, and a bottom face. The secondary label abutting the main label on the first through third sides of the secondary label. A tab portion integral with and extending outwardly from the fourth side of the secondary label, the tab portion also extending outwardly from the main label, past the fourth side of the main label. And adhesive substantially covering the bottom faces of the main and secondary labels.

According to yet another aspect of the present invention a method of recording receipt of a package having a label assembly is provided. The label assembly includes a main label having a secondary label removably contained within the main label, both the labels having a bottom face substantially covered with adhesive and a tab integral with the secondary label extending outwardly from both the secondary and main labels, and a release material segment substantially covering the adhesive on the bottom face of the secondary label. The method comprises the steps of substantially sequentially: (a) Applying the adhesive on the bottom face of the main label to a package with the secondary label contained within the main label, the adhesive on the bottom face of the secondary label isolated from the package by the release material segment. (b) Obtaining an acknowledgment of a person receiving the package to which the main label is applied on the secondary label. (c) Detaching the secondary label with acknowledgment from the package and main label by grasping the secondary label at the tab and peeling it away from the release material segment. And (d) applying the detached secondary label adhesive to another object distinct from the package (such as a piece of paper of a record book).

The tab is separated from the secondary label by a perforation line, and there is preferably the further step (e) after step (c) of detaching the tab from the secondary label. The release material segment slightly overlaps the secondary label on three sides thereof, and is held to the adhesive of the main label on those three sides. Step (d) may be practiced by applying the secondary label to a piece of paper in a record book. There is also preferably the further step (f) prior to step (a), of removing the main label with secondary label and release material segment, from the main body of release material.

It is the primary object of the present invention to provide a simple, inexpensive, yet effective label assembly, and a method of utilization thereof to provide an acknowledgment for receipt of a package. This and other objects of the invention will become clear from an inspection of the detailed description of the invention and from the appended claims.

BRIEF DESCRIPTION OF THE DRAWINGS

FIG. 3 is a top view like that of FIG. 1 showing the main label being removed from the backing, with a first removable segment of the backing being detached along with the label;

FIG. 4 is a top perspective view showing the application of the main label from FIGS. 1 and 3 to a package; and FIG. 5 is a view like that of FIG. 4 showing the removal of the secondary label from the main label of FIG. 4, and attachment thereof to a page of a record book.

DETAIL DESCRIPTION OF THE DRAWINGS

Figure 1:
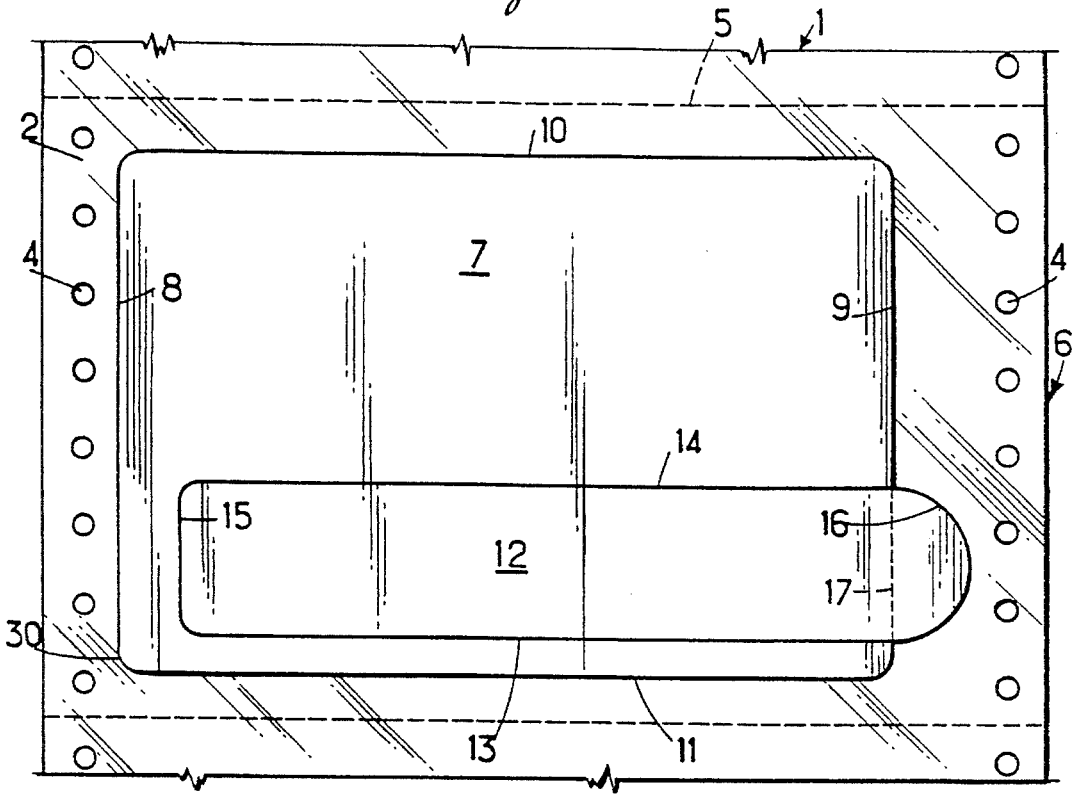
FIG. 1 is a top plan view of a label assembly according to the present invention.

FIG. 1 illustrates a continuous web 1 of release material 2, such as paper coated with wax, silicone, or conventional release materials, with tractor drive openings 4 disposed along the side edges thereof for feeding the web 1 through various pieces of label forming equipment during construction, and feeding of the labels ultimately produced through a printer or like handling equipment. Transverse lines of weakness, such as perforation lines 5, define the web 1 into individual label assemblies 6, each having a main label 7 associated therewith.

The main label 7 is formed by die cutting a continuous web of label stock that covers the release material 2 and removing the matrix material. The main label 7 has side edges 8 through 11 which are spaced from the tractor drive openings 4 and the perforation lines 5, and within the main label 7 is a secondary label 12 defined by die cut lines 13 through 15 forming three edges thereof which are typically completely contained within the main label 7. The secondary label 12 is formed by an additional die cutting operation, or by die cutting at the same time that the main label 7 is die cut, and preferably the die cutting is performed so that a tab 16 is also cut from the original label stock material, the tab 16 integral with the secondary label 12. A line of weakness, such as perforation line 17, is preferably provided in alignment with the rightmost edge 9 of the label 7 (as seen in FIG. 1), to allow detachment of the tab 16 from the rest of the secondary label 12 when desired.

Figure 2:
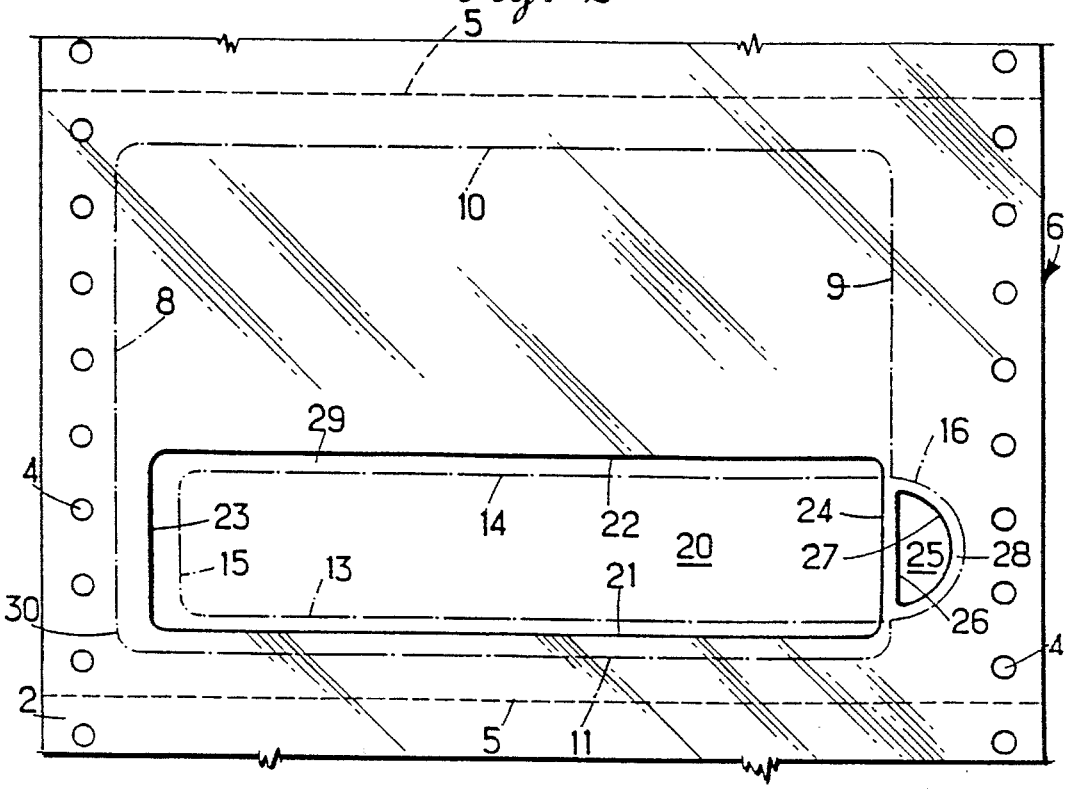
FIG. 2 is a bottom plan view of the label assembly of FIG. 1 with portions of the labels shown in dotted line.

During manufacture of the label assembly 6, a die cutting operation is also performed on the bottom face of the backing 2 (see FIG. 2) to define a first removable segment 20 of the backing 2. The removable segment 20 is defined by the die cut lines 21–24, with a second removable segment 25 of the backing 2 defined by the die cut lines 26, 27. As illustrated in FIGS. 2 and 3, there is a portion 28 of the tab 16 which overlaps the second removable portion 25, however the first removable portion 20 overlaps the edges 13–15 of the secondary label 12.

Applied to the bottom face of the label 7, as well as the secondary label 12 including the tab portion 16 thereof, is adhesive 34 (see FIG. 3). The adhesive 34 may be any suitable type of adhesive, and preferably substantially completely covers the bottom faces of the main label 7 and secondary label 12, although small portions of the label bottom faces can remain uncovered (for example the lower left hand corner 30 of the main label 7 as illustrated in FIG. 1, to facilitate peeling away of the label 7 starting at the corner 30, from the backing 2). Preferably the same adhesive 34 covers the bottom faces of the label 7, 12, and the tab 16, for ease of construction. The adhesive 34 is preferably permanent adhesive, although removable or repositional adhesive can be utilized under some circumstances.

As schematically illustrated in FIG. 3, adhesive 34 exerts a greater force on the first removable segment 20 (particularly at the areas where the first removable segment 20 overlaps the edges 13–15 of the removable label 12) than the rest of the backing 2 does so that when the main label 7 is removed from the backing 2, the first removable segment 20, as well as the second removable segment 25, detach from the backing 2 and remain with the main and secondary labels 7, 12.

The label assembly 6 according to the present invention may be readily constructed using basically conventional techniques, there being no necessity for applying a piggy-back label, a separate adhesive on one portion than another, etc. In fact, all that is necessary that is not normally utilized in the manufacture of a label assembly 6 is the provision of the additional die cut lines 13 through 15, 21 through 24, 26, and 27.

The web 1, after construction of labels 7, 12, may be fed through a printer in which various indicia is applied to the top faces of the label 7, 12. For example, as illustrated in FIG. 3, first indicia 35, typically an outgoing address, is provided on the main label 7, while second indicia 36, such as a line for a signature, instructions for application of a signature, or a like acknowledgment, is provided on secondary label 12. Third indicia, such as the return address indicia 37, may also be provided on the main label 7.

The label assembly 6 is used, according to the invention, in a method of recording receipt of a package. First, the main label 7, with the secondary label 12 and removable segments 20, 25 associated therewith, is removed from the backing 2, e.g. by hand. The adhesive 34 is then applied to a package 40 as illustrated schematically in FIG. 7. The outgoing address indicia 35 indicates where the package 40 is to be sent. Once the package 40 is delivered, a signature (such as a handwritten name of an individual receiving, or a like acknowledgment) is provided on the secondary label 12 where indicated by the indicia 36, and the delivering agent grasps the tab 16 (which is only lightly adhered to the package 40 because of removable backing segment 25) and peels the secondary label 12 away from the release material provided by the backing first removable segment 20, completely detaching the removable label 12 therefrom as illustrated in FIGURE 5. The adhesive 34 on the back of the secondary label 12 is then used to affix it to another object, such as a piece of paper 42 comprising a page of a record book. Once the secondary label 12 has been affixed to the record book page 42, the tab 16 may be detached, by tearing along the perforation line 17.

It will thus be seen that according to the present invention a simple, easy, and inexpensive to construct label assembly providing a self-contained acknowledgment portion is provided, as well as an advantageous method of recording receipt of a package having a label assembly associated therewith. While the invention has been herein shown and described in what is presently conceived to be the most practical and preferred embodiment, it will be apparent to those of ordinary skill in the art that many modifications may be made thereof within the scope of the invention, which scope is to be accorded the broadest interpretation of the appended claims so as to encompass all equivalent assemblies and methods.

What is claimed is:

1. A label assembly comprising:

a backing of release material;

a main label of label stock, having a top face and a bottom face:

adhesive substantially covering said bottom face;

a first die cut formed in said main label, defining a secondary label substantially within said main label; and a second die cut formed in said backing overlapping said first die cut to define a first removable segment of said backing;

said adhesive exerting a greater force on said first removable segment than the rest of said backing, so that when said main label is removed from said backing, said first removable segment detaches from said backing and remains with said main and secondary labels.

2. A label assembly as recited in claim 1 wherein said adhesive comprises permanent adhesive completely covering said bottom face of said main and secondary labels.

3. A label assembly as recited in claim 1 further comprising different first and second indicia provided on said top face of said main label, and said secondary label, respectively.

4. A label assembly as recited in claim 1 in web form in combination with a plurality of substantially identical labels, said backings of said labels connected together at lines of weakness.

5. A label assembly as recited in claim 1 further comprising a tab integral with and extending outwardly from said secondary label, and exteriorly of said main label.

6. A label assembly as recited in claim 5 wherein said secondary label is quadrate, having four sides; and wherein said first removable segment overlaps said secondary label along three sides thereof, said tab extending from the fourth side.

7. A label assembly as recited in claim 5 wherein said adhesive is also provided on said bottom face of said tab; and further comprising a third die cut formed in said backing in alignment with said tab to define a second removable segment, said adhesive exerting a greater force on said second removable segment than the rest of said backing, so that when said main label is removed from said backing, said second removable segment detaches from said backing and remains with said tab.

8. A label assembly as recited in claim 7 wherein said adhesive comprises permanent adhesive completely covering said bottom face of said main and secondary labels and said tab.

9. A label assembly as recited in claim 7 further comprising a line of weakness between said tab and the rest of said secondary label.

10. A label assembly as recited in claim 9 further comprising different first and second indicia provided on said top face of said main label, and said secondary label, respectively.

11. A label assembly as recited in claim 10 in web form in combination with a plurality of substantially identical labels, said backings of said labels connected together at lines of weakness.

12. A label assembly comprising:

a main quadrate label having first through fourth sides, a top face, and a bottom face;

a secondary quadrate label having first through fourth sides, a top face, and a bottom face;

said secondary label abutting said main label on said first through third sides of said secondary label;

a tab portion integral with and extending outwardly from said fourth side of said secondary label;

said tab portion extending outwardly from said main label, past said fourth side of said main label; and adhesive substantially covering said bottom faces of said main and secondary labels.

13. A label assembly as recited in claim 12 wherein the same adhesive is provided covering said bottom faces of both said main and secondary labels.

14. A label assembly as recited in claim 13 wherein said adhesive is permanent adhesive.

15. A label assembly as recited in claim 12 wherein said adhesive also covers the bottom face of said tab portion.

16. A label assembly as recited in claim 12 further comprising a first segment of release material completely covering said secondary label bottom face and overlapping said main label along said first through third sides of said secondary label, so that said release material is releasably adhered to both said main and secondary labels by said adhesive.

17. A label assembly as recited in claim 16 further comprising first indicia on said top face of said main label, and second indicia, different than said first indicia, on said secondary label top face.

18. A label assembly as recited in claim 16 further comprising a second segment of release material covering at least part of said tab portion.

19. A label assembly as recited in claim 18 wherein said fourth side of said secondary label comprises a line of weakness extending between said tab portion and said secondary label.

20. A label assembly as recited in claim 16 further comprising a main body of release material completely overlapping said main label and tab portion and surrounding said first segment of release material, said main body separated from said first segment so that said adhesive has greater affinity for said first segment than said first segment has for said main body so that upon removal of said main label from said main body of release material, said secondary label and said first segment are removed with said main label.

21. A label assembly as recited in claim 12 wherein said fourth side of said secondary label comprises a line of weakness extending between said tab portion and said secondary label.

22. A label assembly as recited in claim 12 further comprising first indicia on said top face of said main label, and second indicia, different than said first indicia, on said secondary label top face; and wherein said adhesive is permanent adhesive.

23. A method of recording receipt of a package having a label assembly, the label assembly including a main label having a secondary label removably contained within the main label, both the labels having a bottom face substantially covered with adhesive, and a tab integral with the secondary label extending outwardly from both the secondary and main labels, and a release material segment substantially covering the adhesive on the bottom face of the secondary label; said method comprising the steps of substantially sequentially:

(a) applying the adhesive on the bottom face of the main label to a package with the secondary label contained within the main label, the adhesive on the bottom face of the secondary label isolated from the package by the release material segment;

(b) obtaining the acknowledgment of a person receiving the package to which the main label is applied on the secondary label;

(c) detaching the secondary label with acknowledgment from the package and main label by grasping the secondary label at the tab and peeling it away from the release material segment; and (d) applying the detached secondary label adhesive to another object distinct from the package.

24. A method as recited in claim 23 wherein the tab is separated from the secondary label by a perforation line; and comprising the further step (e), after step (c), of detaching the tab from the secondary label.

25. A method as recited in claim 23 wherein the release material segment slightly overlaps the secondary label on three sides thereof, and is held to the adhesive of the main label on those three sides; and wherein step (d) is practiced by applying the secondary label to a piece of paper.

26. A method as recited in claim 25 comprising the further step (e), prior to step (a), of removing the main label, with secondary label and release material segment, from a main body of release material.

* * * * *